US007089894B2

(12) United States Patent
Hopper et al.

(10) Patent No.: US 7,089,894 B2
(45) Date of Patent: Aug. 15, 2006

(54) ELECTROMECHANICAL VALVE ACTUATOR ASSEMBLY

(75) Inventors: Mark L. Hopper, Ypsilanti, MI (US); John D. Norton, Ann Arbor, MI (US); Shawn H. Swales, Canton, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 10/963,892

(22) Filed: Oct. 13, 2004

(65) Prior Publication Data

US 2005/0081807 A1 Apr. 21, 2005

Related U.S. Application Data

(60) Provisional application No. 60/510,988, filed on Oct. 14, 2003.

(51) Int. Cl.
*F01L 9/04* (2006.01)

(52) U.S. Cl. ..... 123/90.11; 123/90.15; 123/90.24; 123/193.3; 251/129.07; 251/129.09; 251/129.15; 251/129.2; 335/235; 335/276

(58) Field of Classification Search ..... 123/90.11, 123/90.24
See application file for complete search history.

(56) References Cited

U.S. PATENT DOCUMENTS

| | | | | |
|---|---|---|---|---|
| 4,269,388 | A | 5/1981 | Seilly et al. | |
| 4,762,095 | A | 8/1988 | Mezger et al. | |
| 5,161,494 | A | 11/1992 | Brown, Jr. | |
| 5,720,468 | A * | 2/1998 | Morinigo | 251/129.1 |
| 5,772,179 | A * | 6/1998 | Morinigo et al. | 251/129.1 |
| 6,085,704 | A | 7/2000 | Hara | |
| 6,164,253 | A | 12/2000 | Alberter et al. | |
| 6,262,498 | B1 | 7/2001 | Leiber | |
| 6,418,892 | B1 | 7/2002 | Donce et al. | |
| 6,427,649 | B1 | 8/2002 | Cristiani et al. | |
| 6,427,650 | B1 * | 8/2002 | Cristiani et al. | 123/90.11 |
| 6,457,444 | B1 | 10/2002 | LaDow | |
| 6,467,441 | B1 | 10/2002 | Cristiani et al. | |
| 6,516,758 | B1 | 2/2003 | Leiber | |
| 6,526,928 | B1 * | 3/2003 | Bauer et al. | 123/90.11 |
| 6,546,904 | B1 | 4/2003 | Marchioni et al. | |
| 6,561,144 | B1 | 5/2003 | Muraji | |
| 6,568,358 | B1 * | 5/2003 | Hoerl et al. | 123/90.11 |
| 6,637,385 | B1 | 10/2003 | Muraji | |
| 6,718,620 | B1 * | 4/2004 | Paasch et al. | 29/602.1 |
| 6,810,840 | B1 * | 11/2004 | von Gaisberg-Helfenberg | 123/90.11 |
| 2002/0057154 | A1 | 5/2002 | Keck | |
| 2003/0177989 | A1 | 9/2003 | Baker | |
| 2004/0108482 | A1 | 6/2004 | Sakuragi et al. | |

FOREIGN PATENT DOCUMENTS

| | | |
|---|---|---|
| WO | WO 99/06677 | 2/1999 |

OTHER PUBLICATIONS

"Camless Technology" Engine Technology International, Feb. 2001 (1 page).
DaimlerChrysler—Special Publication On The 24th International Vienna Motor Symposium, May 15-16, 2003, 37 pages.

* cited by examiner

*Primary Examiner*—Thomas Denion
*Assistant Examiner*—Kyle M. Riddle
(74) *Attorney, Agent, or Firm*—Dickinson Wright PLLC

(57) ABSTRACT

A lever electromechanical valve actuator assembly and arrangement of electromechanical valve actuators that creates a compact actuator assembly to increase ease of serviceability, provide space for engine components and eliminate interference between the actuators and components in the vehicle engine compartment.

31 Claims, 10 Drawing Sheets

ELECTROMECHANICAL VALVE ACTUATOR ASSEMBLY

CROSS-REFERENCE TO RELATED APPLICATION

This application claims the benefit of U.S. Provisional Application No. 60/510,988, filed Oct. 14, 2003, the entire disclosure of this application being considered part of the disclosure of this application and hereby incorporated by reference.

BACKGROUND OF THE INVENTION

The present invention relates to electromechanical valves actuators and, more particularly, to compact electromechanical valve actuator assemblies and the arrangement of electromechanical valve actuators on an engine.

As engine technology advances and manufacturers strive to increase engine power, improve fuel economy, decrease emissions, and provide more control over engines, manufacturers are developing electromechanical valve actuators (also known as electromagnetic valve actuators or EMVA) to replace cam shafts for opening and closing engine valves. Electromechanical valve actuators allow selective opening and closing of the valves in response to various engine conditions.

Electromechanical valve actuators generally include two electromagnets and a spring loaded armature plate disposed between the electromagnets. The armature plate is movable between the electromagnets as the power coils are selectively energized to create a magnetic force to attract the armature plate to the energized electromagnet. The surface of the electromagnets to which the armature is attracted is generally referred to as a pole face and the armature is operationally coupled to the valve so that as the armature moves between pole faces in a pole-face-to-pole-face operation, the valve is opened and closed.

Electromechanical valve actuators are generally formed as linear electromechanical valve actuators or lever electromechanical valve actuators. One problem with linear electromechanical valve actuators is that each electromechanical valve actuator operationally coupled to the associated valve includes a relatively large set of electromagnets for opening and closing the valves (FIG. 1). The size of the electromagnets makes it difficult to position all of the linear electromechanical valve actuators over a particular cylinder, especially for engines that have four or more valves per cylinder. The size of linear electromechanical valve actuators may also limit the ease of serviceability of the engine, such as by restricting the space available for changing the spark plug. Another problem with linear electromechanical valve actuators is that linear electromechanical valve actuators generally have a substantial height extending from the cylinder head of an engine. The height of the linear electromechanical valve actuators makes them difficult to package engines in today's compact and full engine compartments. For example, linear electromechanical valve actuators may interfere with other engine parts, other components or accessories located in the engine compartment, and even the vehicle body structure, such as, the hood. Yet another problem with linear electromechanical valve actuators is that they generally draw a substantial amount of power from the vehicle electrical system, as compared with lever electromechanical valve actuators, thereby putting additional demand on the alternator in today's power hungry vehicles.

In view of the drawbacks associated with linear electromechanical valve actuators, many manufacturers have recently turned to lever electromechanical valve actuators, which due to their mechanical and magnetic properties have substantial power savings over linear electromechanical valve actuators. Lever electromechanical valve actuators also generally do not protrude as far from the cylinder head as linear electromechanical valve actuators. However, a major problem with lever electromechanical valve actuators is still the package size required on the cylinder head. Due to the set locations of valves by engine designers, designs for actuator assemblies on the engine have been traditionally limited. Most lever electromechanical valve actuators packaged on the cylinder head are arranged longitudinally in line with the cylinder head as a group, as shown in FIG. 2, with each actuator group being arranged laterally across the cylinder head. As shown in FIG. 2, the lever electromechanical valve actuators on an engine having four valves 20 per cylinder 16 requires significantly more space laterally across a cylinder head than cam shafts, thereby presenting packaging concerns in engine compartments where space is limited. Also, the arrangement of lever electromechanical valve actuators shown in FIG. 2 raises additional serviceability concerns, especially for the ease of servicing and replacing the spark plug and in some arrangements, the fuel injector. In the embodiment illustrated in FIG. 2, at least two of the actuators are completely within the perimeter of the cylinder walls extended toward the actuators, making it difficult to change the spark plug as well as service the actuators. Therefore, there is a need for additional electromechanical valve actuator arrangements that minimize package space, provide ease of serviceability, and provide room wiring assemblies and control modules communicating with the individual actuators.

SUMMARY OF THE INVENTION

The present invention relates to electromechanical valve actuators and, more particularly, to compact electromechanical valve actuator assemblies and the arrangement of electromechanical valve actuators on an engine.

Careful arrangement of electromechanical valve actuators to create a compact assembly increases ease of serviceability, provides space for access to various engine components such as the spark plug, provides additional package space for wiring harnesses and control modules of electromechanical valve actuators, and eliminates potential interference between the actuators and components in the vehicle engine compartment or the vehicle body.

In a first embodiment, the lever electromechanical valve actuator assembly includes a first actuator having a first pivot end and a first lever end, and a second actuator adjacent to said first actuator, said second actuator including a second pivot end and a second lever end. The first and second actuators are oriented in the same direction and arranged such that the first lever end is in closer proximity to the second pivot end than the second lever end. In a second embodiment, a lever electromechanical valve actuator assembly includes a first actuator having a first pivot end and a first lever end and a second actuator including a second pivot end and a second lever end wherein the second actuator is approximately a mirror image of the first actuator and oriented opposing the first actuator. In a third embodiment, the lever electromechanical valve actuator assembly is located on at least two adjacent cylinders, with at least two actuators on each cylinder. The two actuators on a first cylinder face the same direction, while the two actuators on the adjacent cylinder each face a direction substantially opposite the first direction.

Further scope of applicability of the present invention will become apparent from the following detailed description, claims, and drawings. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detailed description given here below, the appended claims, and the accompanying drawings in which:

DETAILED DESCRIPTION OF THE PREFERRED EMBODIMENT

Figure 1:
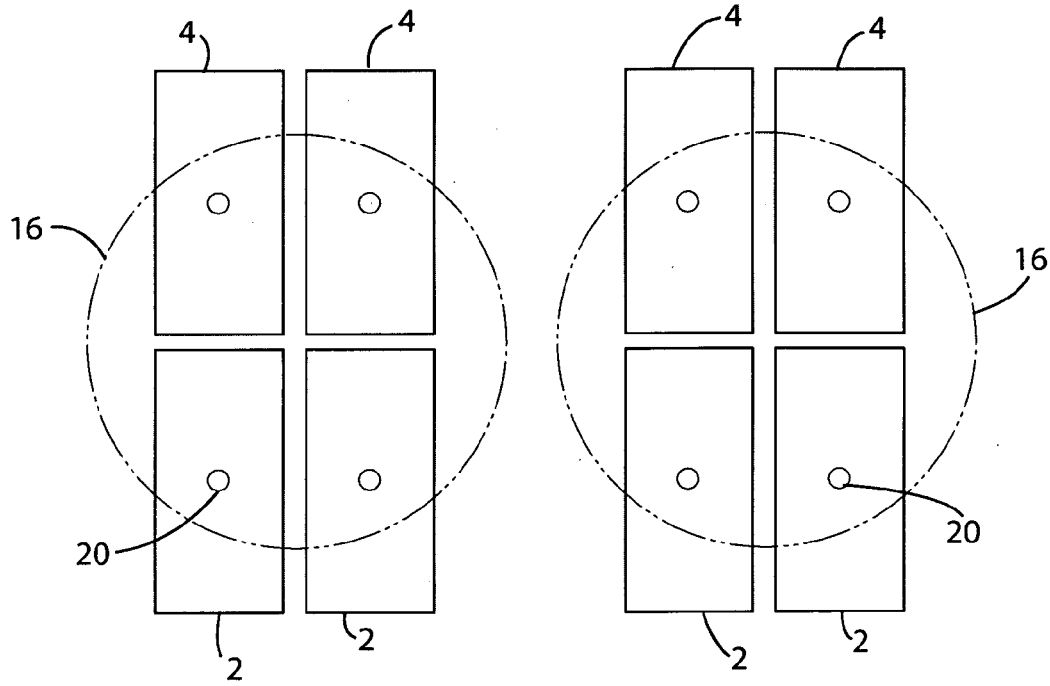
Fig. 1 (Prior Art)
FIG. 1 is a prior art top plan view of the placement of linear electromechanical valve actuators over cylinders.
Figure 2:
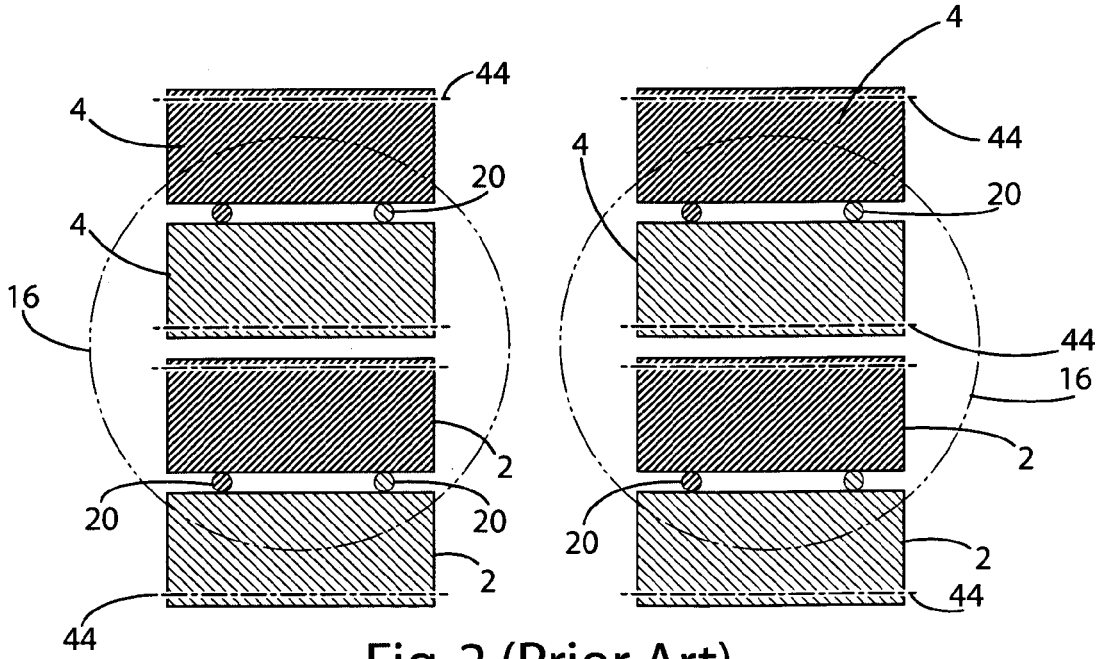
Fig. 2 (Prior Art)
FIG. 2 is a prior art top plan view of the lever electromechanical valve actuators over cylinders.
Figure 3:
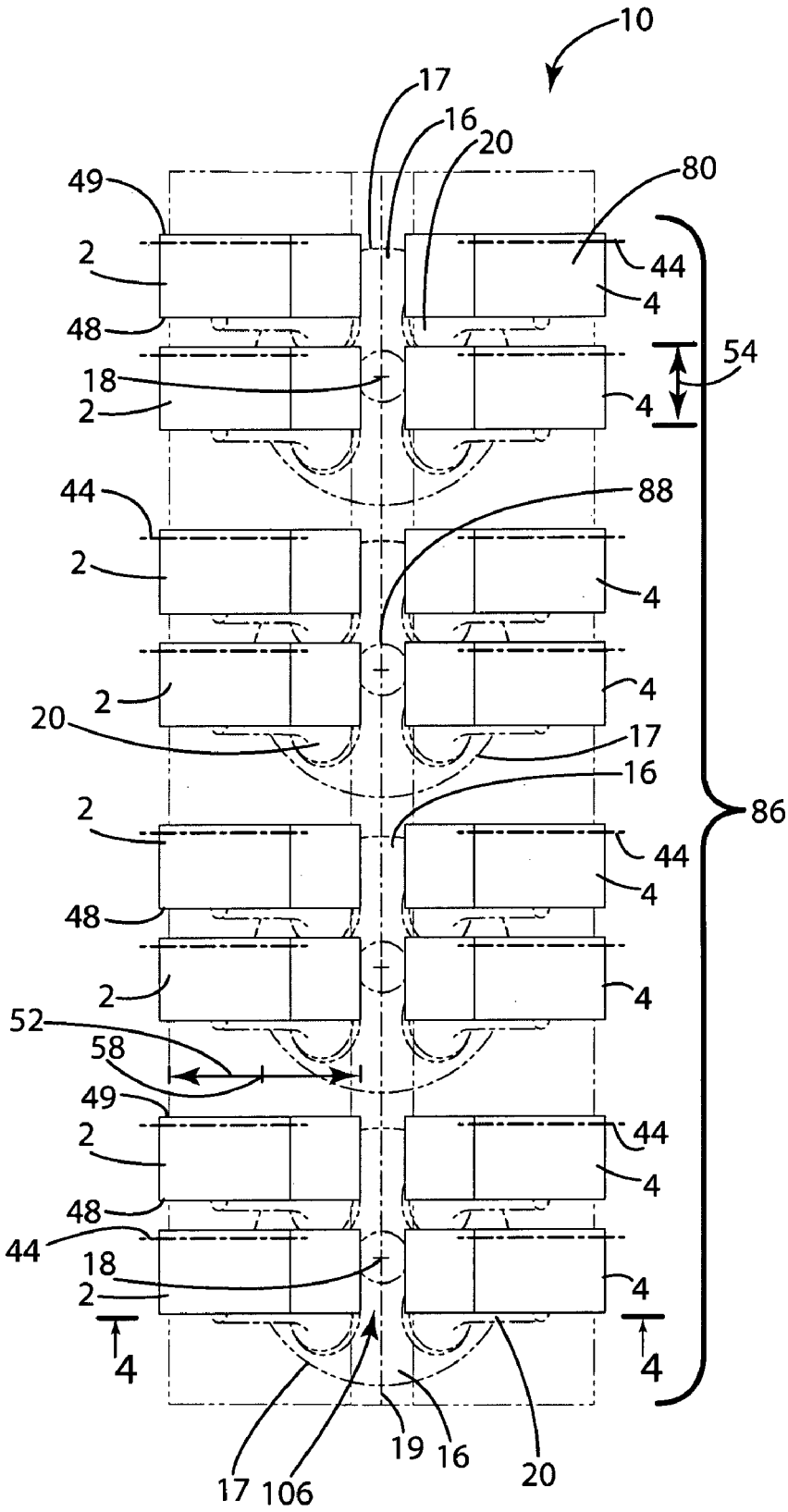
FIG. 3 is a top plan view of the lever electromechanical valve actuator assembly on a cylinder head.

A lever electromechanical valve actuator assembly 10 is illustrated in FIG. 3, mounted on a cylinder head 80 of an internal combustion engine 12 and at least partially over the associated cylinder 16. Each actuator 2, 4 of the lever electromechanical valve actuator assembly 10 is connected to a valve 20, such as an intake or exhaust valve, to open and close the valve 20 as desired. The electromechanical valve actuator assembly 10, as illustrated in FIG. 3, and as illustrated in the alternative embodiments shown in FIGS. 5–11, provides a more compact arrangement while allowing greater serviceability and easier assembly.

Figure 8:
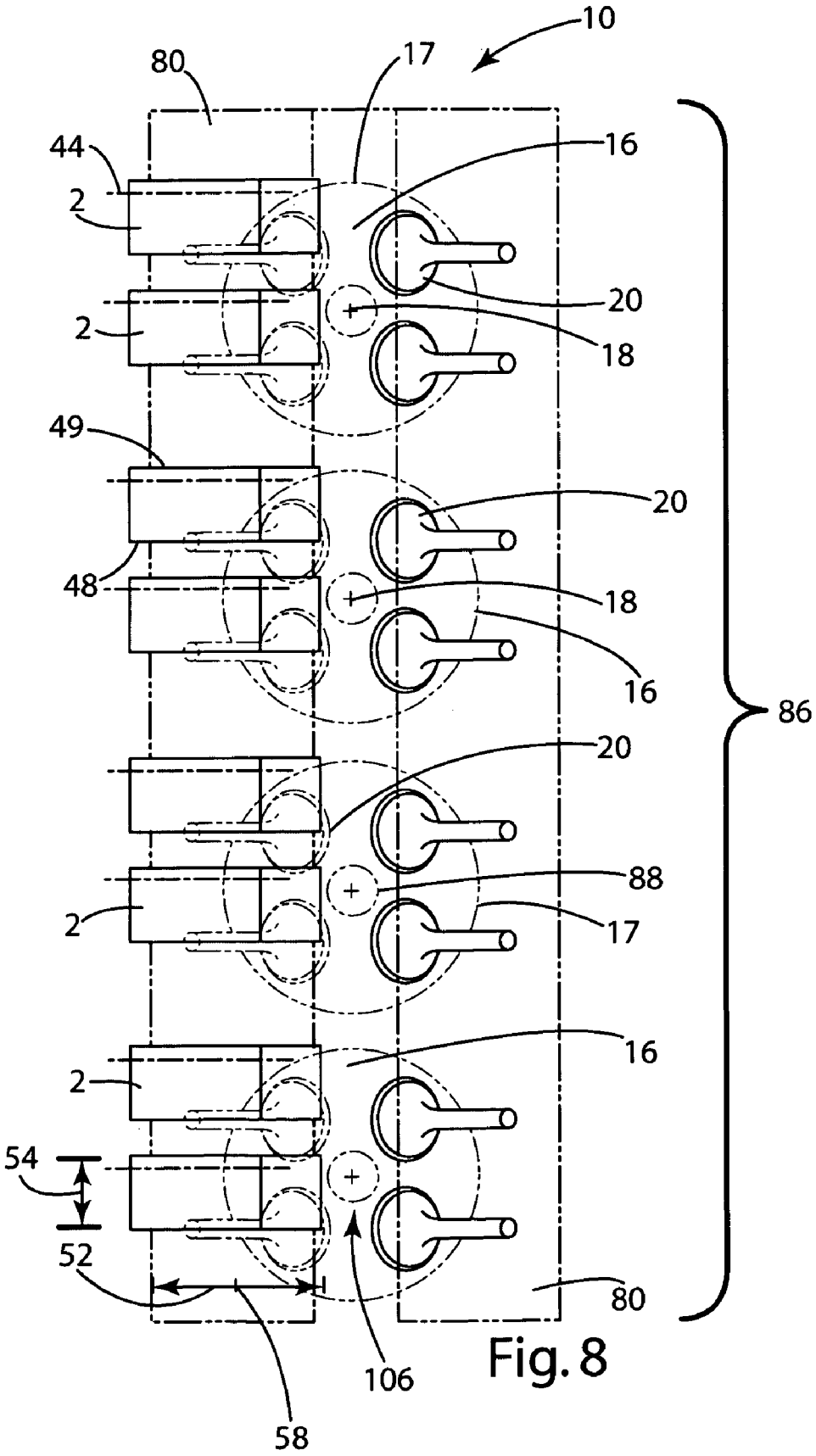
FIG. 8 is a top plan view of the lever electromechanical valve actuator assembly arrangement on a cylinder head having only intake valve actuators.
Figure 9:
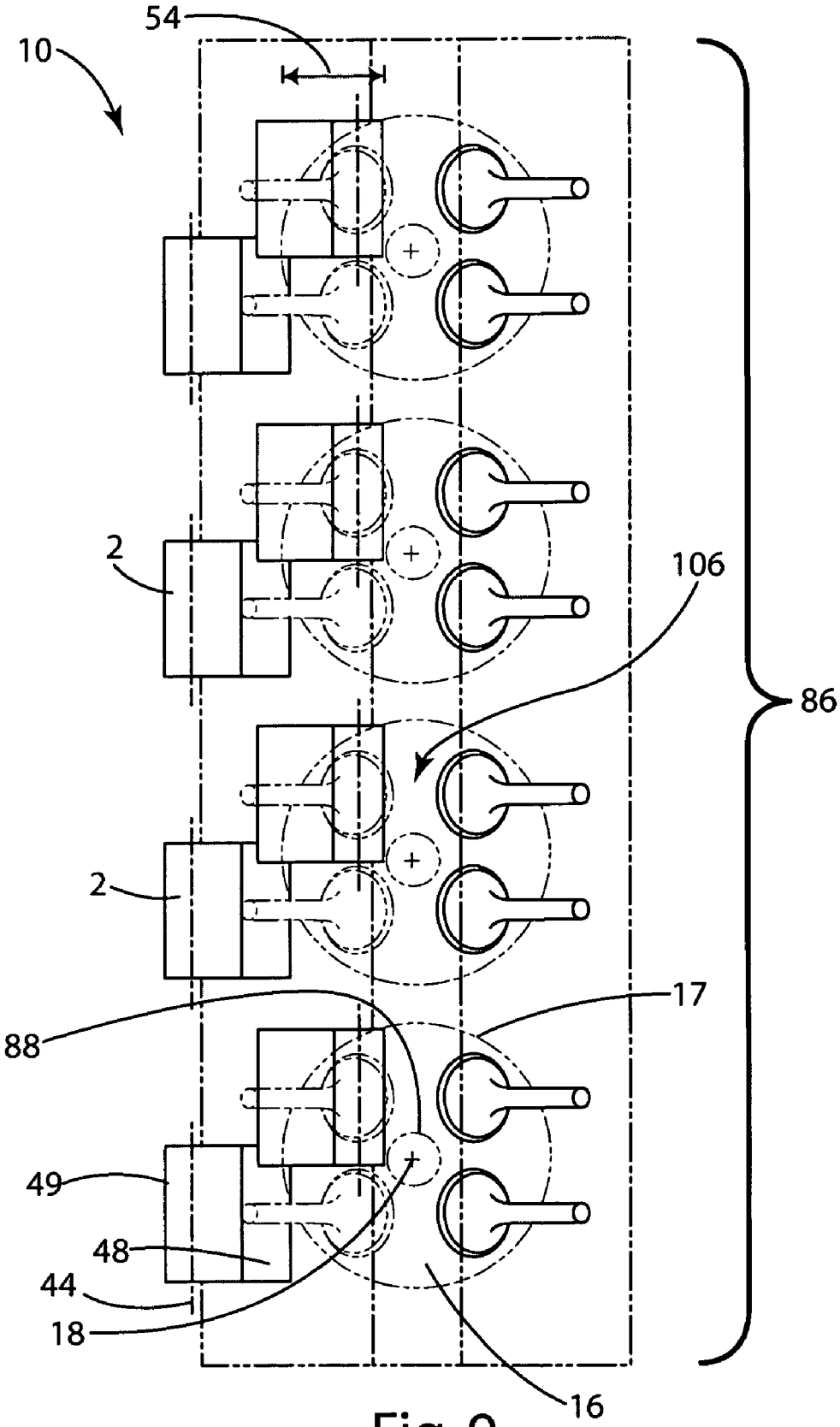
FIG. 9 is a top plan view of the first alternative lever electromechanical valve actuator assembly arrangement on a cylinder head with only intake actuators.
Figure 10:
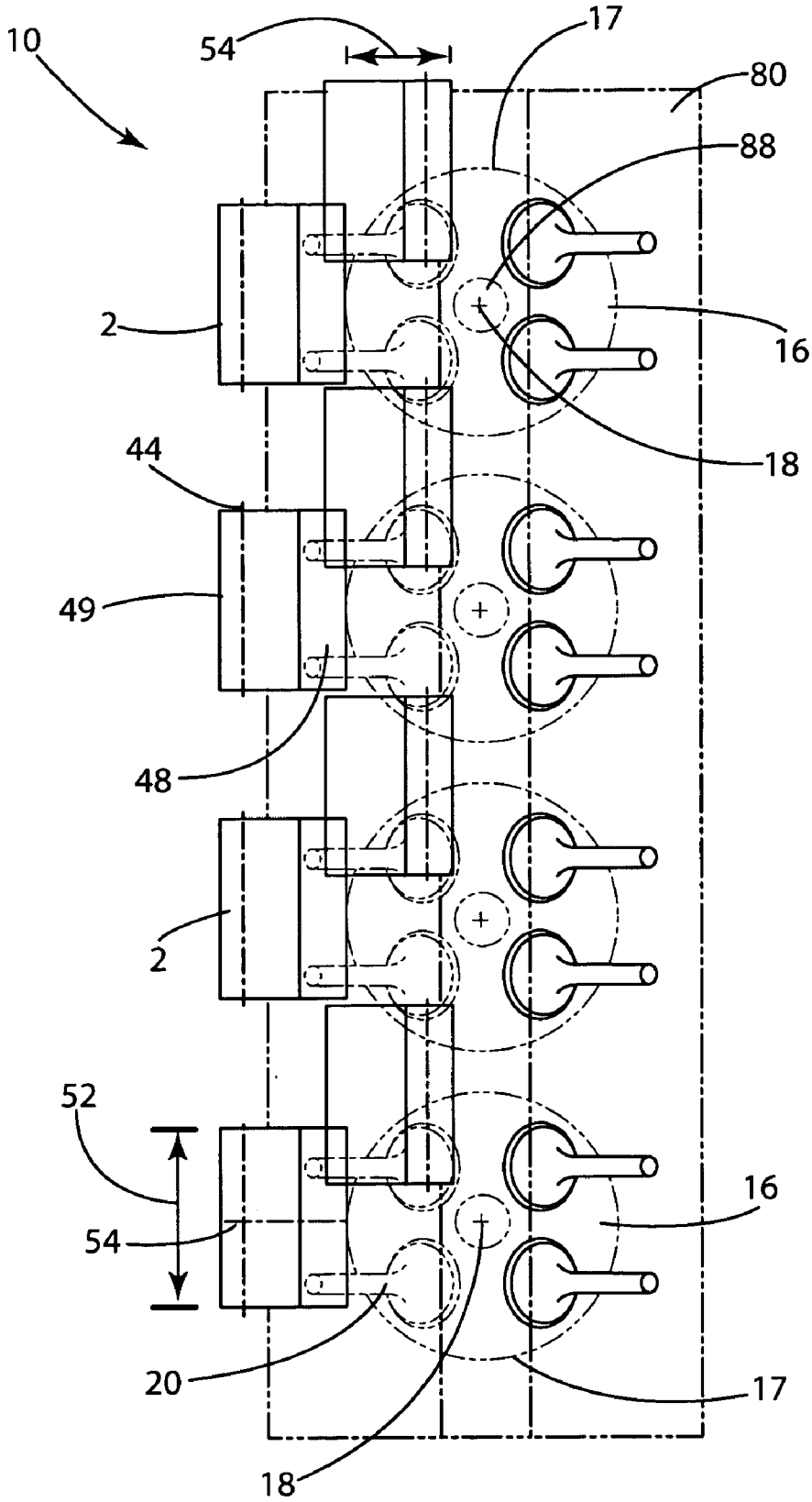
FIG. 10 is a top plan view of the second alternative lever electromechanical valve actuator assembly arrangement on a cylinder head with intake actuators only.

The electromechanical valve actuator assembly 10 generally includes both intake actuators 2 and exhaust actuators 4 as illustrated in FIGS. 3 and 4–7. Of course, the actuator assembly 10 may include only intake actuators 2 as illustrated in FIGS. 8–10, only exhaust actuators (not shown), or a combination of the illustrated and claimed embodiments varying by cylinder or by intake or exhaust sides. For example, one actuator assembly may be suited for the intake side while another may be suited for the exhaust side, or different actuator assemblies may be used for different cylinders depending on engine configuration and packaging needs. The actuators 2, 4 each generally include an armature assembly 30 having an armature plate 32, an electromagnet assembly 70 having electromagnets 72, 74, a connecting rod 90 and a spring assembly 60. The armature plate 32 is alternatively attracted to the electromagnets 72, 74 thereby applying force to the spring assembly 60 and valve 20 through the connecting rod 90 to open and close the valve 20. While the actuators 2, 4 are illustrated as having a connecting rod 90 connected to the spring assembly 60, any lever electromechanical valve actuator configuration, shape, or assembly may be substituted for the illustrated electromechanical valve actuators in FIG. 4, as the present invention is primarily directed to the arrangement of the electromechanical valve actuators 2, 4 relative to each other, relative to the cylinder head 80 and relative to the cylinders.

Figure 4:
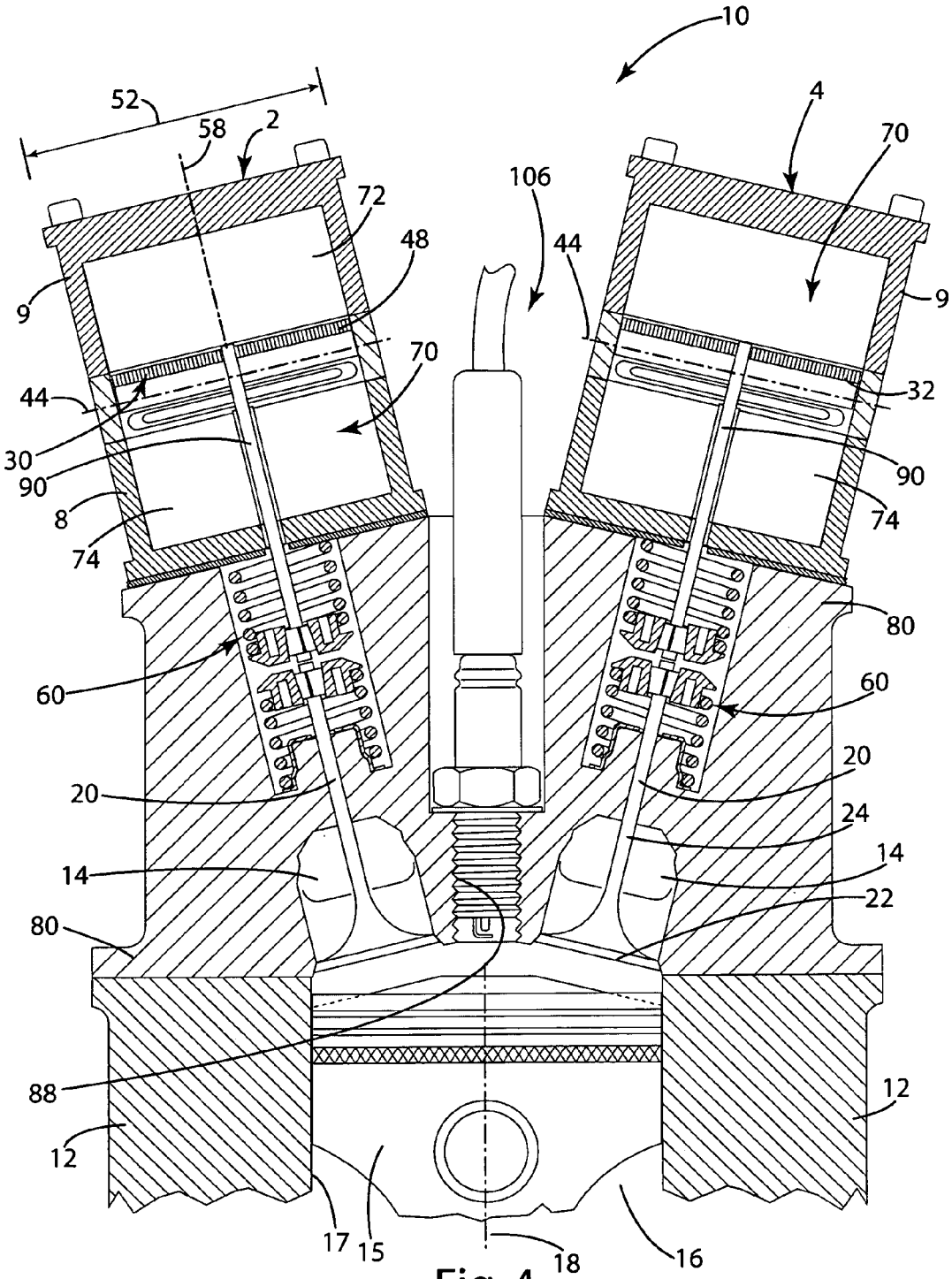
FIG. 4 is a cross-sectional view along lines 4—4 in FIG. 3.

The valve 20 is similar to traditional valves and generally includes a valve head 22 with a valve stem 24 extending therefrom. The valve 20 has an opened and closed position and is illustrated in FIG. 4 in the closed position. In the closed position, the valve head 22 seals a valve port 14 to the corresponding cylinder 16. The valve port 14 may be an exhaust port or intake port and the actuator 2, 4 located thereon is either the intake actuator 2 for an intake port or an exhaust actuator 4 for an exhaust port.

The electromagnet assembly 70 controls the movement of the armature assembly and thereby the movement of the valve 20. The electromagnets 72, 74 are generally secured to c-blocks 8, 9 which are in turn secured to the cylinder head 80.

The armature assembly 30 includes the armature plate 32 and the connecting rod 90. The armature plate 32 pivots about a pivot axis 44 near a pivot end 49 of the armature plate 32 to open and close the valve 20. The connecting rod 90 is coupled to or driven by the armature plate 32. The lever end 48 of the armature plate 32 is opposite the pivot end 49. While any electromechanical valve actuator may be used in the present invention to create the lever electromechanical valve actuator assembly 10, the electromechanical valve actuators 2, 4 described above and illustrated in FIG. 4 provide further space savings and further facilitate the arrangement of the electromechanical valve actuators.

To facilitate the description of the electromechanical valve actuator assembly 10 and the specific arrangement of the actuators 2, 4 relative to each other, the geometry and directional arrangement such as longitudinal and lateral extents of the cylinder head 80, the cylinder 16, and the actuators 2, 4 must first be described. The internal combustion engine 12 includes a desired number of cylinders 16. The cylinders 16 may be arranged in any shape or configuration possible for the operation of an internal combustion, such as an in-line four cylinder engine or a V-6 engine. The cylinders 16 each include a cylinder axis 18 in the center along which the piston 15 travels. Cylinders 16 also include an outer perimeter wall 17. In this application and in the claims, when the perimeter is referred to as being extended toward the actuators 2, 4 or the extended perimeter, that description generally refers to not the actual extent of the perimeter 17 defined by the cylinder walls but a theoretical or virtual extension of the perimeter of the cylinder walls, beyond where the cylinder wall perimeter 17 actually stops when it meets the cylinder head 80, toward the actuators 2, 4. The cylinders 16 may further be described as being arranged along a cylinder longitudinal extent 19 which is generally along a longitudinal extent of the engine along a line drawn through the axes 18 of the cylinder 16. The cylinder head 80 also includes a longitudinal extent 86 and defines a spark plug hole 88. The cylinder head 80 is generally banked as shown in FIG. 4.

The actuators 2, 4 generally include a longitudinal actuator extent 52 which is generally aligned with the pivot axis 44 and a lateral actuator extent 54 which is somewhat perpendicular to the pivot axis 44. The actuators 2, 4 may also include a longitudinal actuator center 58 which is approximately the center of the longitudinal actuator extent 52.

In the primary embodiment, illustrated in FIG. 3, the lever electromechanical valve actuator assembly 10 is arranged so that intake actuators 2 are arranged laterally to the cylinder head 80. More specifically, the longitudinal actuator extent 52 is arranged approximately perpendicular to the cylinder head longitudinal extent 86. Therefore, as illustrated in FIG. 3, the actuators 2, 4 are arranged on the cylinder head 80 in a lateral configuration wherein the intake actuators 2 are approximately aligned laterally along the cylinder longitudinal extent 86 and the exhaust actuators 4 are also approximately aligned laterally along the cylinder longitudinal extent 86. In this arrangement, the pivot end 49 of one actuator is arranged in closer proximity to the lever end 48 of the adjacent actuator over the same cylinder 16 than the pivot end 49 of the adjacent actuator. The arrangement of the pivot end 49 being in close proximity to the lever end 48 of the adjacent actuator arranges the actuators so that the actuators are oriented in the same direction and that the pivot end 49 of one actuator is closer to the lever end 48 of the adjacent actuator than the pivot end 49 of adjacent actuator. Further, as illustrated in FIGS. 3 and 8, the intake actuators 2 all face the same direction and if included, as shown in FIG. 3, the exhaust actuators also face the same direction. Of course, the intake actuators 2 may all face the same direction while the exhaust actuators 4 all face the same direction, but opposite the direction of the intake actuators 2 (not shown). As further illustrated in FIG. 3, the pivot axis 44 of the intake actuators 2 are substantially parallel and the pivot axis 44 of the exhaust actuators 4 are also parallel although not necessarily parallel to the intake actuators 2. As illustrated in FIGS. 3 and 4, the pivot axes 44 of the intake actuators 2 and the exhaust actuators 4 are generally angled relative to each other due to the angled arrangement of the valves 20 and the banking of the cylinder head 80. Therefore, even though the intake actuators 2 may be aligned along the cylinder longitudinal extent 86 with an exhaust actuators 4 such that the pivot axes 44 of an intake actuator 2 is aligned with a pivot axis 44 of an exhaust actuator 4, the pivot axes 44 are generally angled relative to each other.

Figure 11:
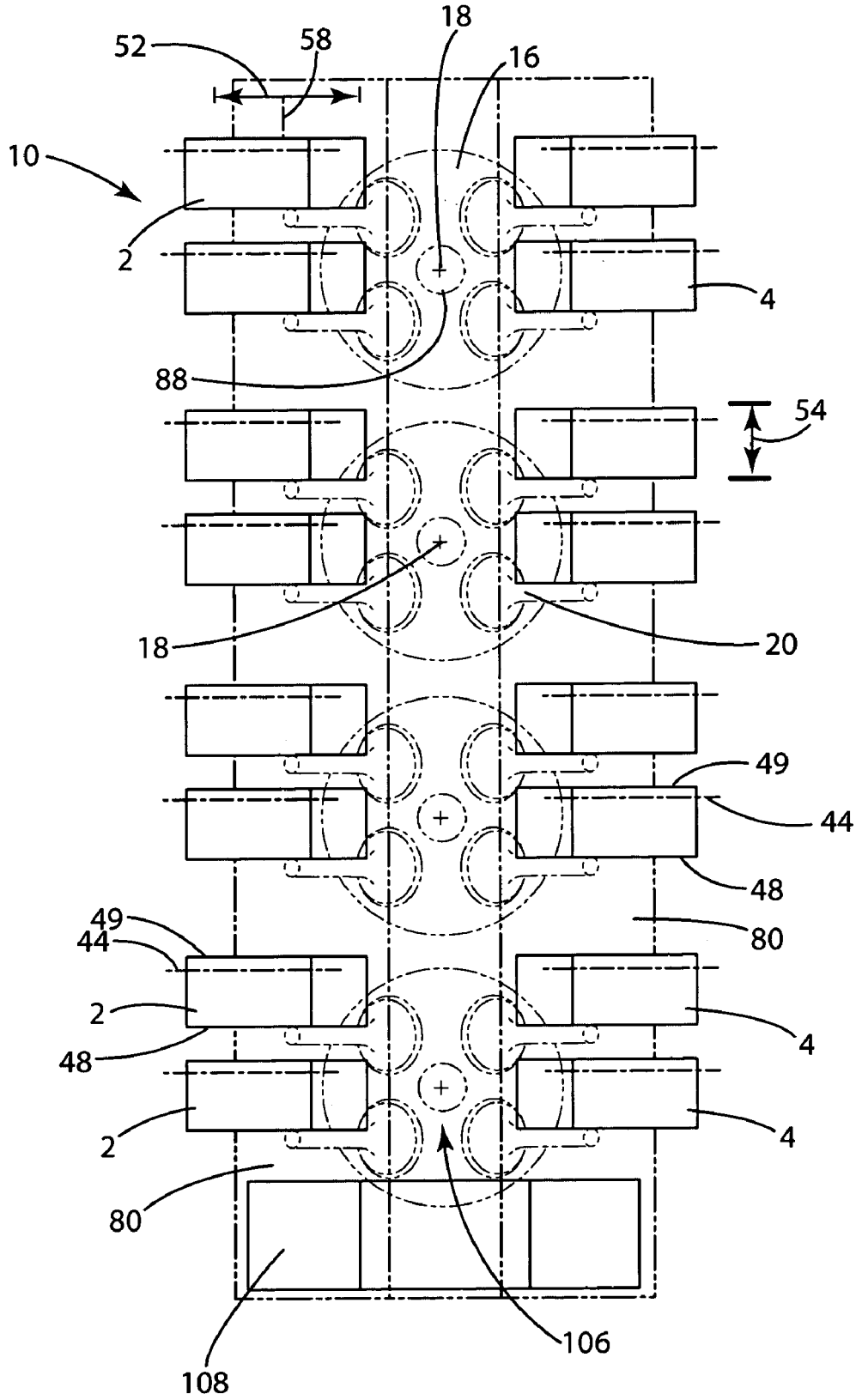
FIG. 11 is a top plan view of the lever electromechanical valve actuator assembly with the exhaust and intake actuators shifted laterally apart on the cylinder head.

As further illustrated in FIGS. 3 and 8, the connecting rod 90 which is coupled to the valve 20 is connected to approximately the center of the longitudinal actuator extent 52, or along the longitudinal actuator center 58. However, as illustrated in FIG. 11, the connecting rod 90 may be coupled to a position on the actuators 2, 4 which is offset from the longitudinal actuator center 58. This offset configuration may allow greater serviceability of the engine and easier access to the spark plug hole 88 defined by the cylinder head 80. Comparing FIGS. 3 and 11, the offset configuration in FIG. 11 shifts the actuators 2, 4 laterally away from each other so that the intake actuators 2 are spaced further from the exhaust actuators in FIG. 11 than in FIG. 3.

In the illustrated embodiment, the actuator assembly 10 is arranged over the cylinders 16. As shown in FIGS. 3, 8, and 11, if the cylinder outer perimeter 17 is extended toward the actuators 2, 4, each of the lever electromechanical valve actuators 2, 4 is located at least partially outside the extended perimeter. Further, as illustrated FIGS. 3, 8, and 11, the actuators 2, 4 are shifted along the cylinder longitudinal extent 19 generally so that the cylinder axis 18 is not centered between the intake actuators 2 on a particular cylinder 16. Therefore, the actuators 2, 4 arranged over a particular cylinder 16 are generally shifted laterally away from the cylinder axis and longitudinally along the cylinder axis 18 to one side of the cylinders 16.

While the spark plug hole 88 in the cylinder head 80 may be centered between the actuators 2, 4 both laterally and longitudinally or centered between one set of actuators 2, 4 such as the intake actuators 2 longitudinally, the actuators 2, 4 are generally shifted along the cylinder longitudinal extents 86 so that the spark plug is not longitudinally centered between the actuators 2, 4. As illustrated in FIGS. 3, 8, and 11, the spark plug hole 88 is approximately centered above the cylinder axis 18 for efficient engine operation.

Figure 5:
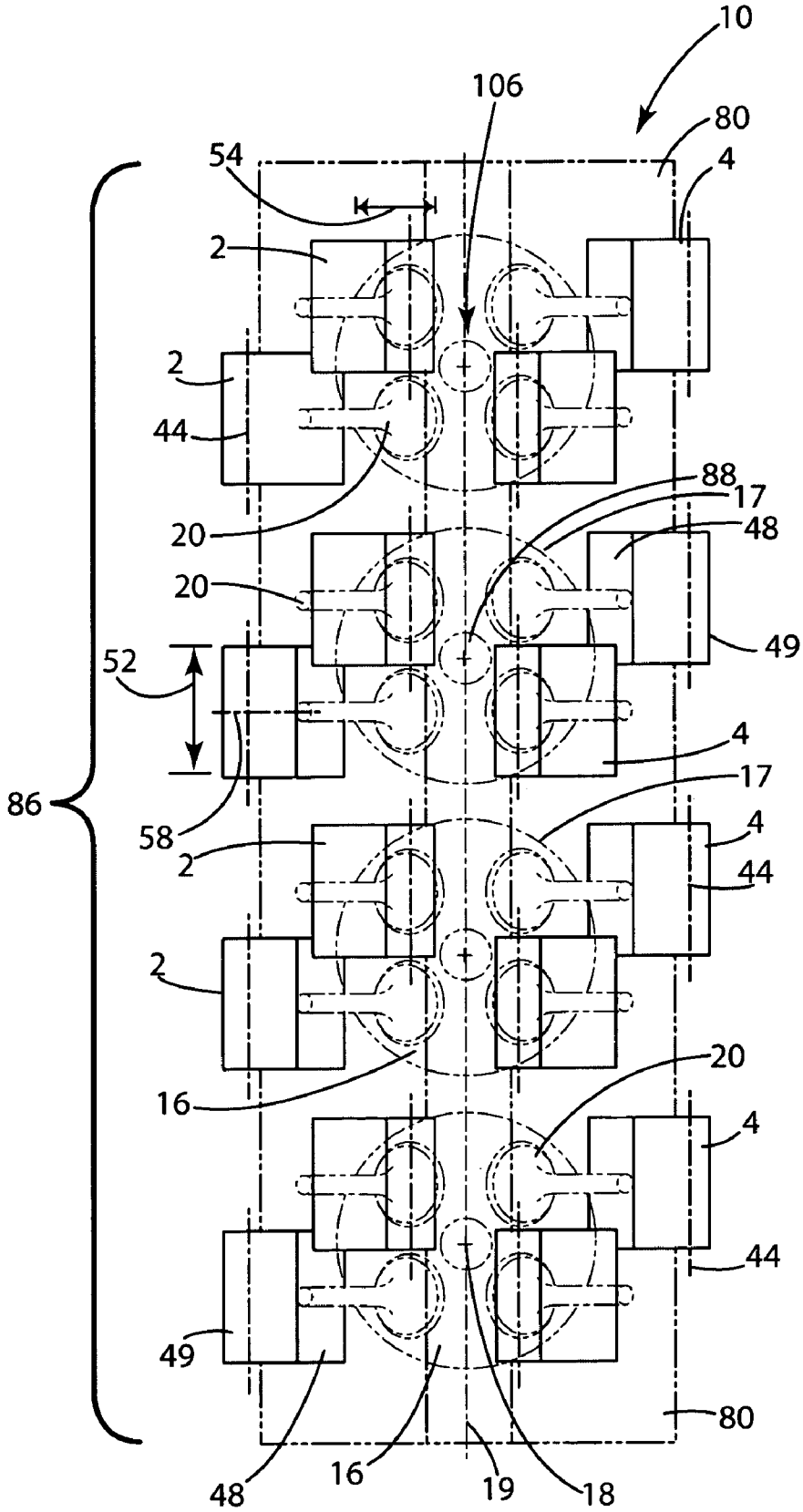
FIG. 5 is a top plan view of a first alternative lever electromechanical valve actuator assembly arrangement on a cylinder head.

In the second embodiment illustrated in FIGS. 5 and 9, the actuator assembly 10 is also arranged such that the pivot axes 44 are parallel. More specifically, in the embodiment illustrated in FIG. 5, the intake actuators over a particular cylinder 16 are arranged such that they are a mirror image of each other with one actuator opposing the adjacent actuator. Further, the actuators 2, 4 are offset relative to the adjacent actuator 2, 4 on the same cylinder 16 along their longitudinal actuator extent. Although the valve 20 and connecting rod 90 are illustrated as being approximately centered along the longitudinal actuator extent 52, the valve coupled to the actuators 2, 4 may be offset from the longitudinal actuator center 58. Therefore, the adjacent actuators 2, 4 over a particular cylinder 16 are arranged such that the lever ends 48 are closer together than the lever end 48 of a particular actuator 2, 4 is to its pivot end 49. As illustrated in FIG. 5, the intake actuators over a particular cylinder 16 are offset relative to each other. Further, the exhaust actuators 4 in the illustrated embodiment are offset approximately the same amount so that one pair of intake and exhaust actuators 2, 4 are laterally aligned along the cylinder longitudinal extent 86 while the other pair are also aligned along the cylinder longitudinal extent 86. Further, in this embodiment each one of the actuators 2, 4 is at least partially located outside the extended outer perimeter 17 of the cylinder 16. With the perimeter extended toward the actuators 2, 4, the area within the extended perimeter 17 is less than half filled by the actuators 2, 4 providing substantial room on the cylinder head 80 between the actuators 2, 4 for serviceability.

Figure 6:
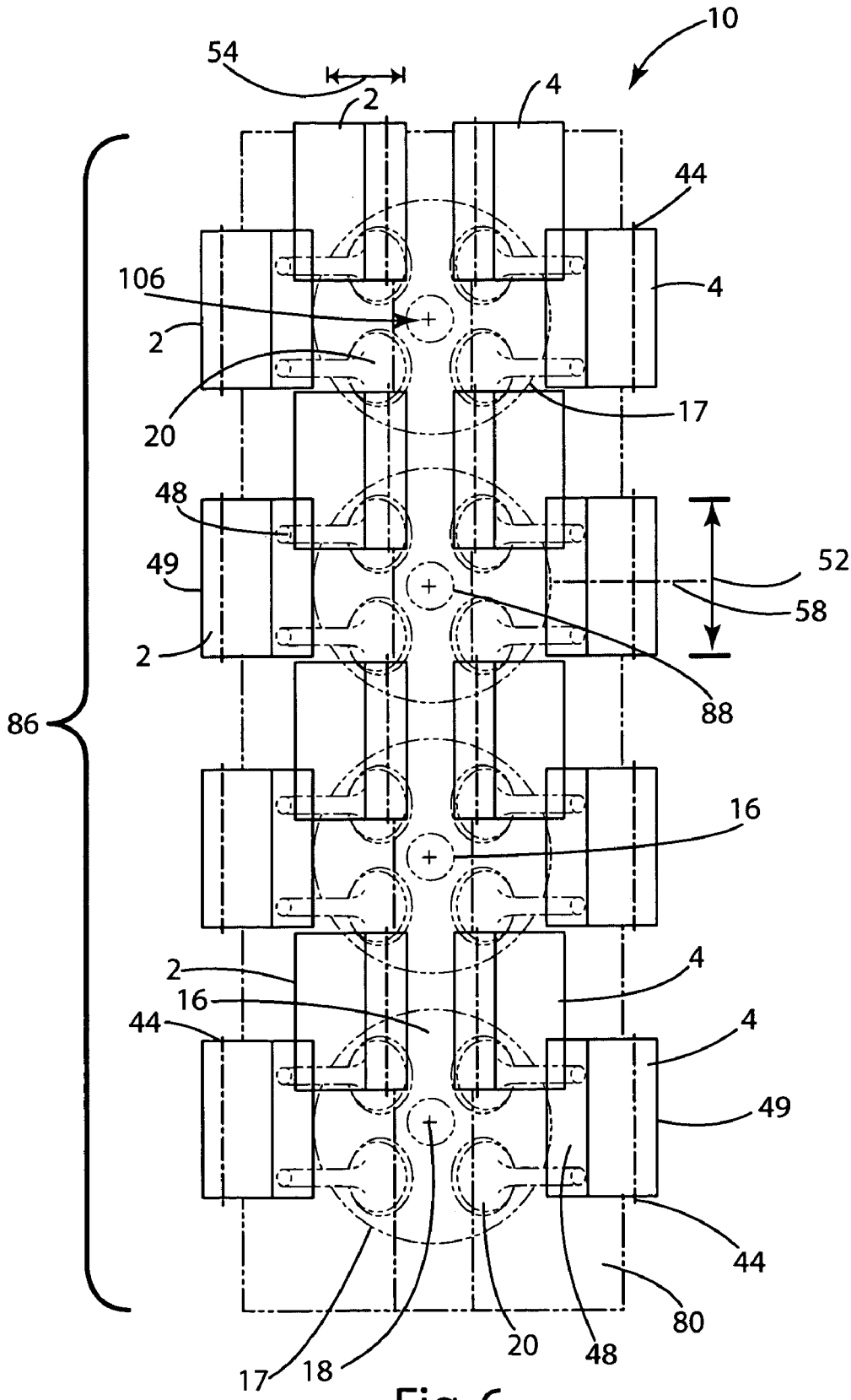
FIG. 6 is a top plan view of a second alternative lever electromechanical valve actuator assembly arrangement on a cylinder head.

The embodiment illustrated in FIGS. 6 and 10 further provides serviceability especially by freeing up area around the spark plug hole 88 on the cylinder head 80 by creating a spark plug access area 106. The arrangement illustrated in FIG. 6 is similar to the arrangement in FIG. 5 in that each of the adjacent actuators is a mirror image of the other actuator. Therefore, in the embodiment shown in FIG. 6, the adjacent actuator associated with a particular cylinder 16 and on the intake or exhaust sides are oriented opposing each other.

Figure 7:
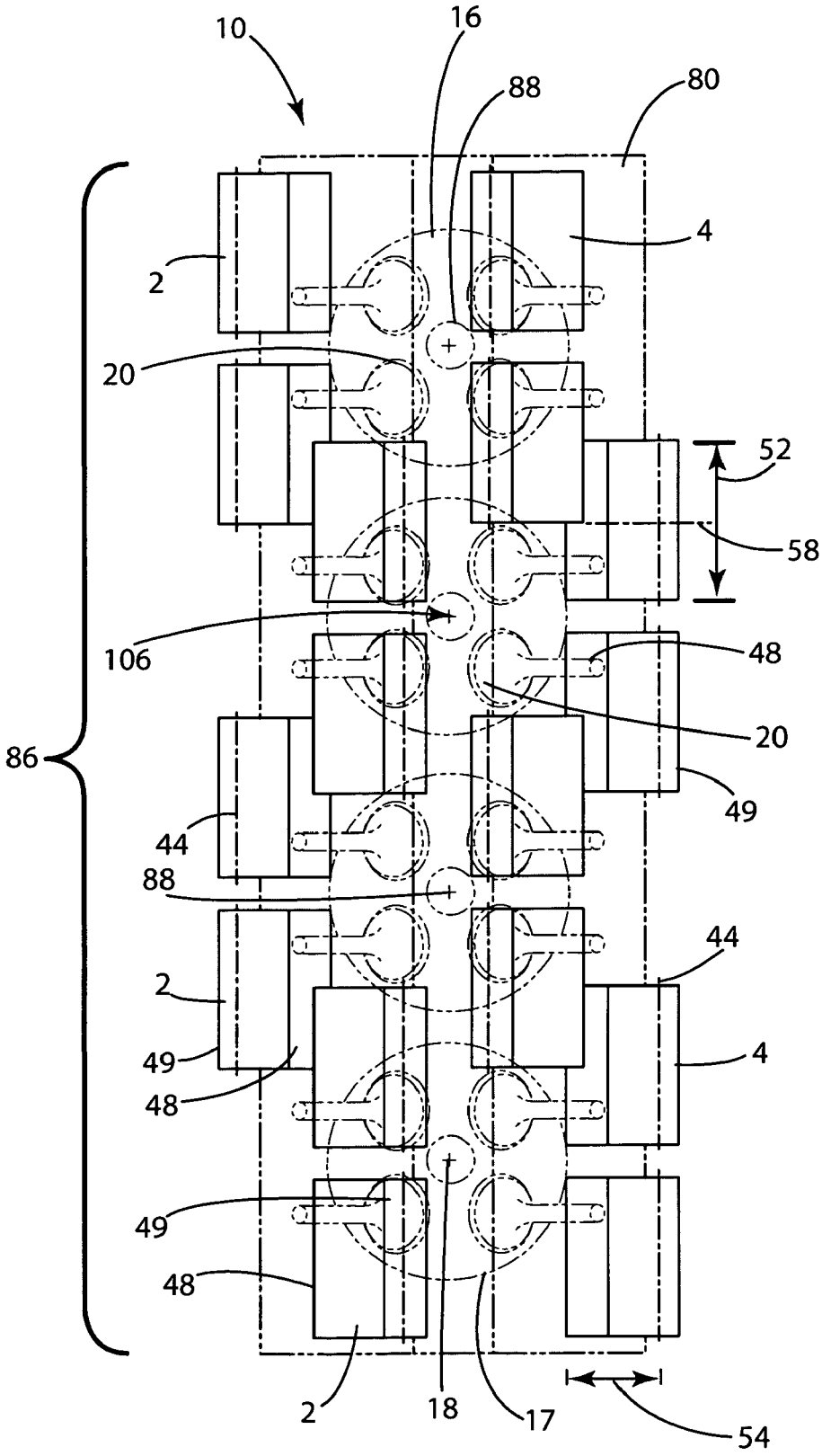
FIG. 7 is a top plan view of a third alternative lever electromechanical valve actuator assembly arrangement on a cylinder head.

In the embodiment illustrated in FIG. 7, while all of the actuators face the same direction over a particular cylinder, the actuators 2, 4 adjacent to each other and slightly overlapping are on adjacent cylinders 16 so that the actuator 2, 4 over one cylinder overlaps the actuator 2, 4 over the adjacent cylinder in a manner such that two actuators oppose each other. Furthermore, in the embodiment shown in FIGS. 6 and 7, at least one actuator is within two of the extended outer perimeters. In each of the embodiments shown in FIGS. 6 and 7, the actuators may also be coupled approximately along the center 58 of the longitudinal actuator extent 52. In the embodiment shown in FIG. 11, a control system, including a control module also may be situated at one end of the cylinder head 80 such that the control system 108 is at least partially situated over one of the extended cylinder perimeters.

The foregoing discussion discloses and describes an exemplary embodiment of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. A lever electromechanical valve actuator assembly for a vehicle engine having cylinders, said electromechanical valve actuator assembly comprising:

a first actuator having a first pivot end and a first lever end;

a second actuator coupled to said first actuator, said second actuator including a second pivot end and a second lever end, and wherein said second actuator and said first actuator are oriented in the same direction and wherein said first and second actuators are arranged so that said first lever end is in closer proximity to said second pivot end than said second lever end.

2. The lever electromechanical valve actuator assembly of claim 1 wherein said first actuator includes a first pivot axis and said second actuator includes a second pivot axis, and wherein said first and second pivot axes are parallel.

3. The lever electromechanical valve actuator assembly of claim 2 further including a third actuator and a fourth actuator and wherein said third actuator includes a third axis and said fourth actuator includes a fourth axis, said third axis being angled relative to said first axis.

4. The lever electromechanical valve actuator assembly of claim 1 further including a third actuator and a fourth actuator and wherein said third actuator and said fourth actuator are oriented in the same direction as said first actuator and said second actuator.

5. The lever electromechanical valve actuator assembly of claim 1 wherein said first and second actuators each include a longitudinal actuator extent and wherein said first and second actuators are coupled to a valve and wherein said valve is approximately centered along said longitudinal actuator extent.

6. The lever electromechanical valve actuator assembly of claim 1 wherein said actuators each include a longitudinal actuator center and wherein said actuators are coupled to a valve assembly and wherein said valve assembly is offset from said longitudinal actuator center.

7. The lever electromechanical valve actuator assembly of claim 1 wherein said first and second actuators are situated over a first cylinder and wherein said first cylinder includes a perimeter, said perimeter being extended toward said first and second actuators and wherein said first and second actuators are each intake actuators located at least partially outside said extended perimeter.

8. The lever electromechanical valve actuator assembly of claim 1 wherein said first and second actuators are situated over a cylinder and wherein said actuator assembly further includes a control system in communication with said actuators, said control system being at least partially situated over said cylinder.

9. The lever electromechanical valve actuator assembly of claim 8 further including a third and fourth actuator each located at least partially outside said extended perimeter.

10. The lever electromechanical valve actuator assembly of claim 8 wherein said cylinders include a second cylinder and wherein each of said first and second cylinders includes an axis, said first and second actuators being arranged over said first cylinder and shifted from the axis of said first cylinder toward the axis of said second cylinder.

11. The lever electromechanical valve actuator assembly of claim 1 wherein said cylinders are arranged along a cylinder longitudinal axis and wherein said actuators are disposed lateral relative to said cylinder longitudinal axis.

12. The lever electromechanical valve actuator assembly of claim 1 wherein said engine further includes a cylinder head between said cylinders and said electromechanical valve actuator assembly, said cylinder head having a longitudinal extent and wherein said electromechanical valve actuators are arranged laterally relative to said cylinder head and said cylinder longitudinal extent.

13. The lever electromechanical valve actuator assembly of claim 12 wherein said cylinder head further includes a spark plug hole and said electromechanical valve actuator assembly further includes a third actuator and a fourth actuator, said spark plug hole being approximately centered between said actuators.

14. The lever electromechanical valve actuator assembly of claim 12 wherein said actuators each include a pivot axis and wherein said pivot axes are parallel.

15. The lever electromechanical valve actuator assembly of claim 12 further including a third actuator having a third axis and wherein said first actuator includes a first axis, said third axis and said first axis being aligned along said longitudinal extent and wherein said first axis is angled relative to said third axis.

16. A lever electromechanical valve actuator assembly for a vehicle engine having cylinders, said electromechanical valve actuator comprising:

a first actuator having a first pivot end and a first lever end;

a second actuator including a second pivot end and a second lever end, and wherein said second actuator is approximately a mirror image of said first actuator and is oriented opposing said first actuator;

wherein each of said first and second actuators include a longitudinal actuator extent and wherein said first actuator is offset relative said second actuator along said longitudinal actuator extents; and wherein said first and second actuators are arranged so that said first lever end is in closer proximity to said second lever end than said second pivot end.

17. The lever electromechanical valve actuator assembly of claim 16 further including a valve coupled to each of said actuators and wherein said valve is coupled to the respective actuator approximately along the center of said longitudinal actuator extent.

18. The lever electromechanical valve actuator assembly of claim 16 further including a valve coupled to each of said actuators and wherein said valve is offset from the centerpoint of said longitudinal actuator extent.

19. The lever electromechanical valve actuator assembly of claim 16 further including a third actuator and a fourth actuator, said actuators each including a longitudinal actuator extent, said first and second actuators being offset along their actuator longitudinal extent and wherein at least one of said third and fourth actuators is aligned with said first actuator along their actuator longitudinal extent and wherein the other of said third and fourth actuators is aligned with said second actuator along their actuator longitudinal extent.

20. The lever electromechanical valve actuator assembly of claim 19 wherein each of said actuators includes an approximately parallel pivot axis.

21. The lever electromechanical valve actuator assembly of claim 16 wherein said actuators are situated over one of said cylinders and wherein said one cylinder includes an outer perimeter, said outer perimeter being extended toward said actuators and wherein said actuators are at least partially located outside said extended outer perimeter.

22. The lever electromechanical valve actuator assembly of claim 16 further including a third actuator and a fourth actuator and wherein said first actuator and said third actuator are oriented in the same direction and said second and fourth actuator are oriented in the same direction and opposing the direction of orientation of said first and third actuators.

23. The lever electromechanical valve actuator assembly of claim 16 wherein said first and second actuators are situated over a cylinder and wherein said actuator assembly further includes a control system communication with said actuators, said control system being at least partially situated over said cylinder.

24. A lever electromechanical valve actuator assembly for a vehicle engine having cylinders, said electromechanical valve actuator comprising:

a first actuator having a first pivot end and a first lever end;

a second actuator including a second pivot end and a second lever end, and wherein said second actuator is approximately a mirror image of said first actuator and is oriented opposing said first actuator;

wherein each of said first and second actuators include a longitudinal actuator extent and wherein said first actuator is offset relative said second actuator along said longitudinal actuator extents;

wherein said actuators are situated over one of said cylinders and wherein said one cylinder includes an outer perimeter, said outer perimeter being extended toward said actuators and wherein said actuators are at least partially located outside said extended outer perimeter; and wherein said extended perimeter has an area, said actuators occupying less than half said area of said extended perimeter.

25. The lever electromechanical valve actuator assembly of claim 24 further including a valve coupled to each of said actuators and wherein said valve is coupled to the respective actuator approximately along the center of said longitudinal actuator extent.

26. The lever electromechanical valve actuator assembly of claim 24 further including a valve coupled to each of said actuators and wherein said valve is offset from the centerpoint of said longitudinal actuator extent.

27. The lever electromechanical valve actuator assembly of claim 24 wherein said first and second actuators are arranged so that said first lever end is in closer proximity to said second lever end than said second pivot end.

28. The lever electromechanical valve actuator assembly of claim 24 further including a third actuator and a fourth actuator, said actuators each including a longitudinal actuator extent, said first and second actuators being offset along their actuator longitudinal extent and wherein at least one of said third and fourth actuators is aligned with said first actuator along their actuator longitudinal extent and wherein the other of said third and fourth actuators is aligned with said second actuator along their actuator longitudinal extent.

29. The lever electromechanical valve actuator assembly of claim 28 wherein each of said actuators includes an approximately parallel pivot axis.

30. The lever electromechanical valve actuator assembly of claim 24 further including a third actuator and a fourth actuator and wherein said first actuator and said third actuator are oriented in the same direction and said second and fourth actuator are oriented in the same direction and opposing the direction of orientation of said first and third actuators.

31. The lever electromechanical valve actuator assembly of claim 24 wherein said first and second actuators are situated over a cylinder and wherein said actuator assembly further includes a control system communication with said actuators, said control system being at least partially situated over said cylinder.

* * * * *

UNITED STATES PATENT AND TRADEMARK OFFICE

CERTIFICATE OF CORRECTION

PATENT NO. : 7,089,894 B2
APPLICATION NO. : 10/963892
DATED : August 15, 2006
INVENTOR(S) : Mark L. Hopper et al.

It is certified that error appears in the above-identified patent and that said Letters Patent is hereby corrected as shown below:

On the Title Page, Col. 2, Item (56), "6,467,441 B1" should be --6,467,441 B2--.

On the Title Page, Item (56), "6,526,928 B1" should be --6,526,928 B2--.

On the Title Page, Item (56), "6,546,904 B1" should be --6,546,904 B2--.

On the Title Page, Item (56), "6,637,385 B1" should be --6,637,385 B2--.

On the Title Page, Item (56), "6,718,620 B1" should be --6,718,620 B2--.

On the Title Page, Item (56), "6,810,840 B1" should be --6,810,840 B2--.

Signed and Sealed this

Twenty-eighth Day of November, 2006

JON W. DUDAS
*Director of the United States Patent and Trademark Office*